US005813844A

United States Patent [19]

Hosono et al.

[11] Patent Number: 5,813,844

[45] Date of Patent: Sep. 29, 1998

[54] OIL PUMP ROTOR HAVING A GENERATED TOOTH SHAPE

[75] Inventors: Katsuaki Hosono; Manabu Katagiri, both of Niigata, Japan

[73] Assignee: Mitsubishi Materials Corporation, Tokyo, Japan

[21] Appl. No.: 764,811

[22] Filed: Dec. 12, 1996

[30] Foreign Application Priority Data

| | | | |
|---|---|---|---|
| Dec. 14, 1995 | [JP] | Japan | 7-326108 |
| Jan. 17, 1996 | [JP] | Japan | 8-006172 |
| Jan. 17, 1996 | [JP] | Japan | 8-006174 |

[51] Int. Cl.[6] ..... F04C 2/10

[52] U.S. Cl. ..... 418/150; 418/171

[58] Field of Search ..... 418/150, 166, 418/171

[56] References Cited

U.S. PATENT DOCUMENTS

| | | | |
|---|---|---|---|
| 3,126,833 | 3/1964 | Hill | 418/167 |
| 4,518,332 | 5/1985 | Saegusa | 418/171 |

FOREIGN PATENT DOCUMENTS

| | | | |
|---|---|---|---|
| 0 110 565 A1 | 6/1984 | European Pat. Off. . | |
| 25 52 454 A1 | 6/1976 | Germany . | |
| 43 11 169 A1 | 10/1994 | Germany . | |
| 61-4882 | 1/1986 | Japan | 418/171 |
| 223 257 | 10/1924 | United Kingdom . | |

*Primary Examiner*—John J. Vrablik

*Attorney, Agent, or Firm*—Armstrong, Westerman, Hattori, McLeland & Naughton

[57] ABSTRACT

The present invention relates to an oil pump rotor for an oil pump provided with an inner rotor 10 to which n (n is a natural number) outer teeth 11 are formed, an outer rotor 20 to which n+1 inner teeth 21 are formed which engage with each of the outer teeth 11, and a casing 30 in which an intake port 31 for taking up fluid and an expulsion port 32 for expelling fluid are formed, wherein:

the outer teeth 11 of inner rotor 10 are formed along an envelope described by a generated group of circles having centers positioned on a trochoid curve generated within the limits satisfying the following expression:

$$0.15 \leqq n \cdot R/(p \cdot D) \leqq 0.25$$

where D is the diameter of the circle which passes through each of the tips of the outer teeth and R is the radius of the generated circle measured in millimeters, while p is π.

14 Claims, 13 Drawing Sheets

$n \cdot R/(\pi \cdot D) = 0.206$ $n \cdot R/(\pi \cdot D) = 0.288$ $n \cdot R/(\pi \cdot D) = 0.103$ $e \cdot n/(\pi \cdot D) = 0.140$ $e \cdot n/(\pi \cdot D) = 0.124$

OIL PUMP ROTOR HAVING A GENERATED TOOTH SHAPE

BACKGROUND OF THE INVENTION

The present invention relates to an oil pump rotor used in an oil pump which intakes and expels a fluid according to changes in the capacity of a plurality of cells which are formed between inner and outer rotors.

Conventional oil pumps are provided with an inner rotor to which n (n being a natural number) outer teeth are formed, an outer rotor to which n+1 inner teeth are formed, for engaging with the outer teeth, and a casing in which an intake port for taking up fluid and an expulsion port for expelling fluid are formed. Here, n indicates a natural number. In this oil pump, the inner rotor is rotated, causing the outer teeth to engage the inner teeth and thereby rotate the outer rotor. Fluid is then taken in or expelled due to changes in the capacity of the plurality of cells which are formed between the rotors.

Individual cells are partitioned due to contact between the respective outer teeth of the inner rotor and the inner teeth of the outer rotor at the front and rear of the direction of rotation, and by the presence of the casing of the oil pump which exactly covers either side of the inner and outer rotors. Thus, independent fluid carrier chambers are formed as a result. Once the capacity of a cell has fallen to a minimum value during the process of engagement between the outer teeth of the inner rotor and inner teeth of the outer rotor, the cell next proceeds along an intake port where its capacity is expanded, causing fluid to be taken up. After the cell's capacity reaches a maximum value, the cell next proceeds along an expulsion port where its capacity is decreased, causing the fluid to be expelled.

In this type of oil pump, a sliding contact is always present between the casing and each edge surface of the inner and outer rotors, and between the outer periphery of the outer rotor and the casing. Further, a sliding contact is also always present between the outer teeth of the inner rotor and the inner teeth of the outer rotor at the front and rear of each cell. While this is extremely important for maintaining the liquid-tight character of the cells which are carrying the fluid, when the resistance generated by each of the sliding parts becomes large, then this sliding contact may cause a significant increase in mechanical loss in the oil pump. Accordingly, reducing the resistance generated by the various sliding parts in an oil pump has been a problem in this field.

Further, the force with which the outer teeth of the inner rotor push the inner teeth of the outer rotor may be broken down into a rotational component which is applied along the tangential line of the inner rotor to rotate the outer rotor, and a slide component which is applied along the radial direction of the inner rotor to generate sliding between the teeth. This slide component is a cause of mechanical loss, however. Accordingly, the reduction of this slide component and an increase in the rotational component has been another problem encountered in this field.

SUMMARY OF THE INVENTION

Accordingly, the present invention was conceived in consideration of the above described circumstances, and has as its objective a reduction in mechanical loss in an oil pump by reducing the resistance which is generated by each of the sliding components in the inner and outer rotors and the casing, while at the same time ensuring the oil pump's durability and reliability.

In order to achieve the aforementioned objective, the oil pump rotor of the present invention is such that the outer teeth of the inner rotor are formed along an envelope formed by a generated group of circles having centers positioned on a trochoid curve generated within the limits which satisfy the following expression:

$$0.15 \leqq n \cdot R/(p \cdot D) \leqq 0.25$$

where D is the tip diameter of the inner rotor and R is the radius of the generated circle, both D and R measured in millimeters, while p is $\pi$.

Further, if e is used to represent the eccentricity between the inner and outer rotors in millimeters, then the outer teeth of the inner rotor in the oil pump of the present invention are formed along an envelope formed by a generated group of circles having centers positioned on a trochoid curve generated within the limits which satisfy the following expression:

$$0.135 \leqq e \cdot n/(p \cdot D) \leqq 0.145$$

In addition, a run-off which is not in contact with the inner teeth of the outer rotor is provided to the front side or to both the front and rear sides of the direction of rotation of the outer teeth of the inner rotor.

By means of the above described design, the resistance generated by each of the sliding parts in the inner rotor, outer rotor and casing is reduced, thereby reducing mechanical loss in this oil pump.

$$0.15 \leqq n \cdot R/(p \cdot D) \leqq 0.25$$

Figure 2:
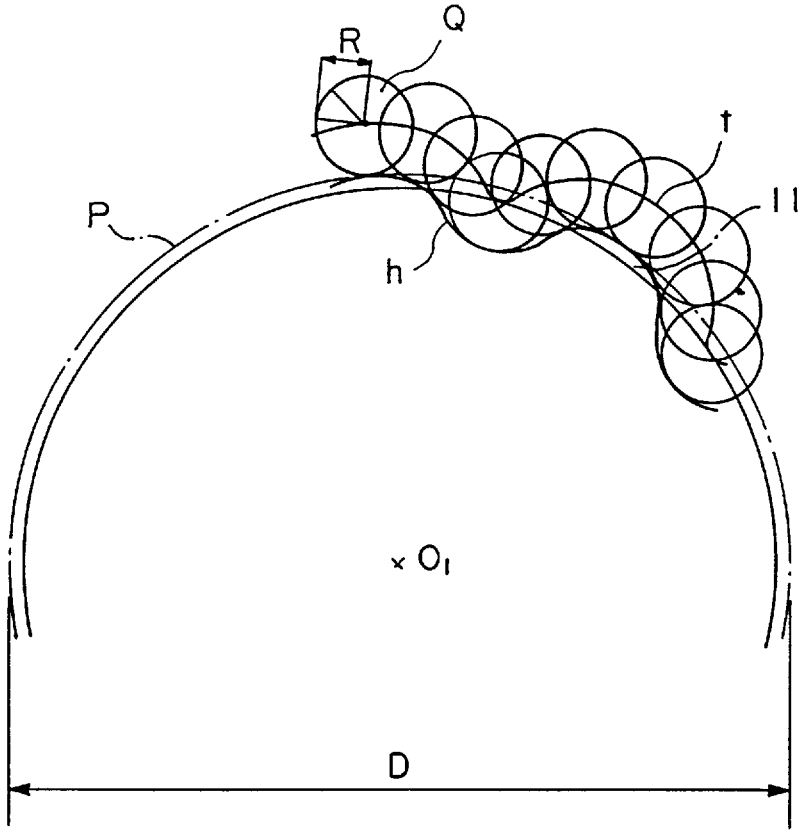

FIG. 2 is a planar view of the manner in which the inner rotor is generated.

Figure 1:
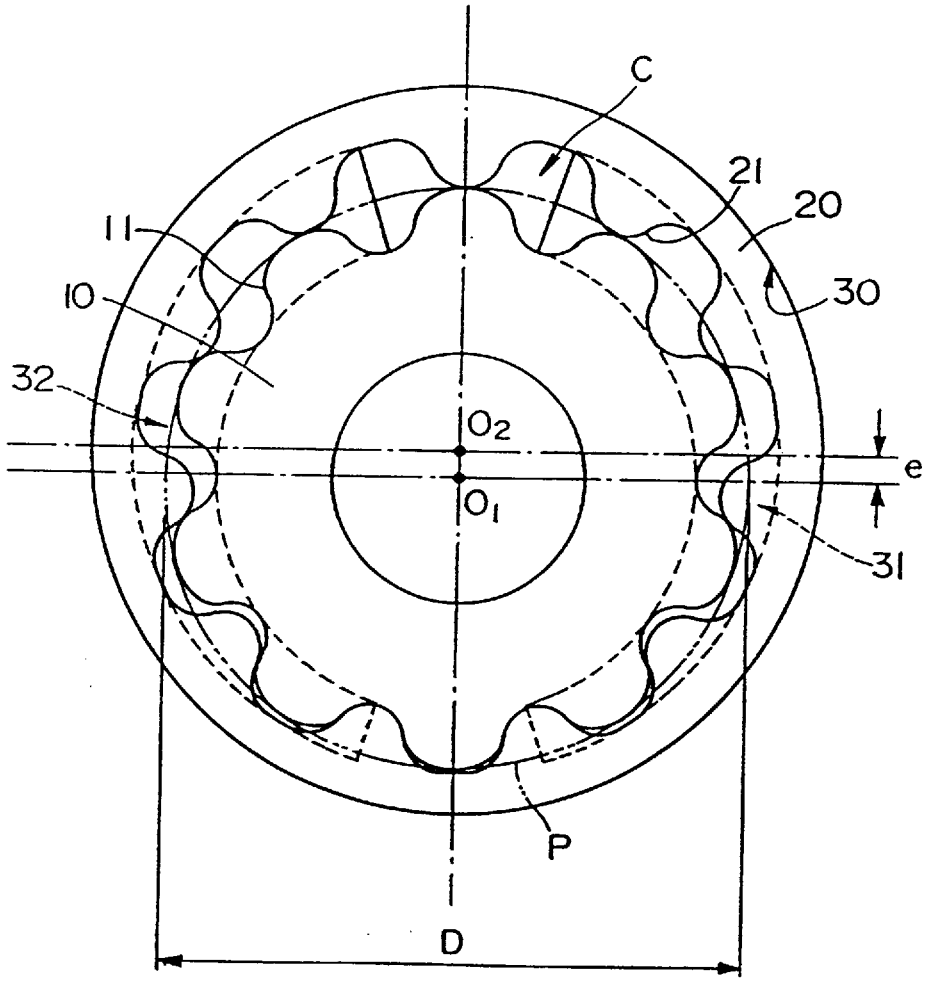
FIG. 1 is a planar view of a first embodiment of the oil pump rotor according to the present invention, wherein the outer teeth of the inner rotor are formed along an envelope described by a generated group of circles having centers positioned on a trochoid curve generated within limits which satisfy the following expression.
Figure 3:
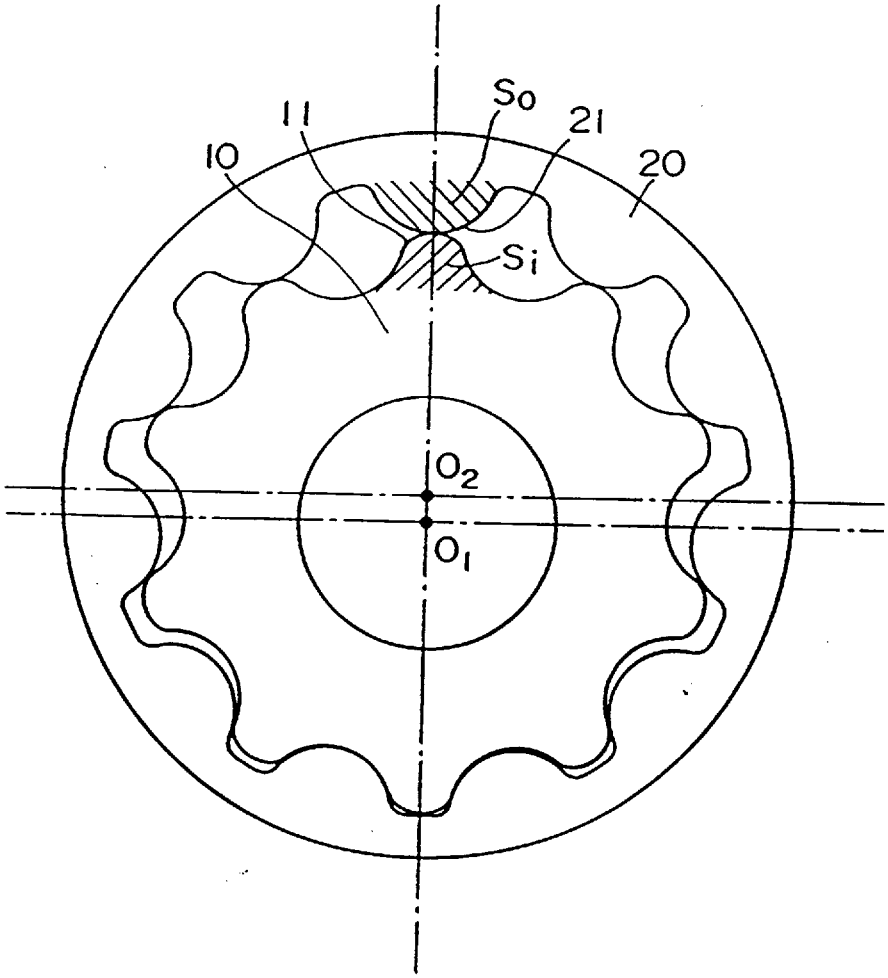

FIG. 3 is a planar view of an oil pump rotor offered as an example for comparison with the oil pump rotor shown in FIG. 1, wherein the outer teeth of the inner rotor are formed along an envelope described by a generated group of circles having centers positioned on a trochoid curve generated within the limits which satisfy the following expression:

$$n \cdot R/(p \cdot D) > 0.25$$

Figure 4:
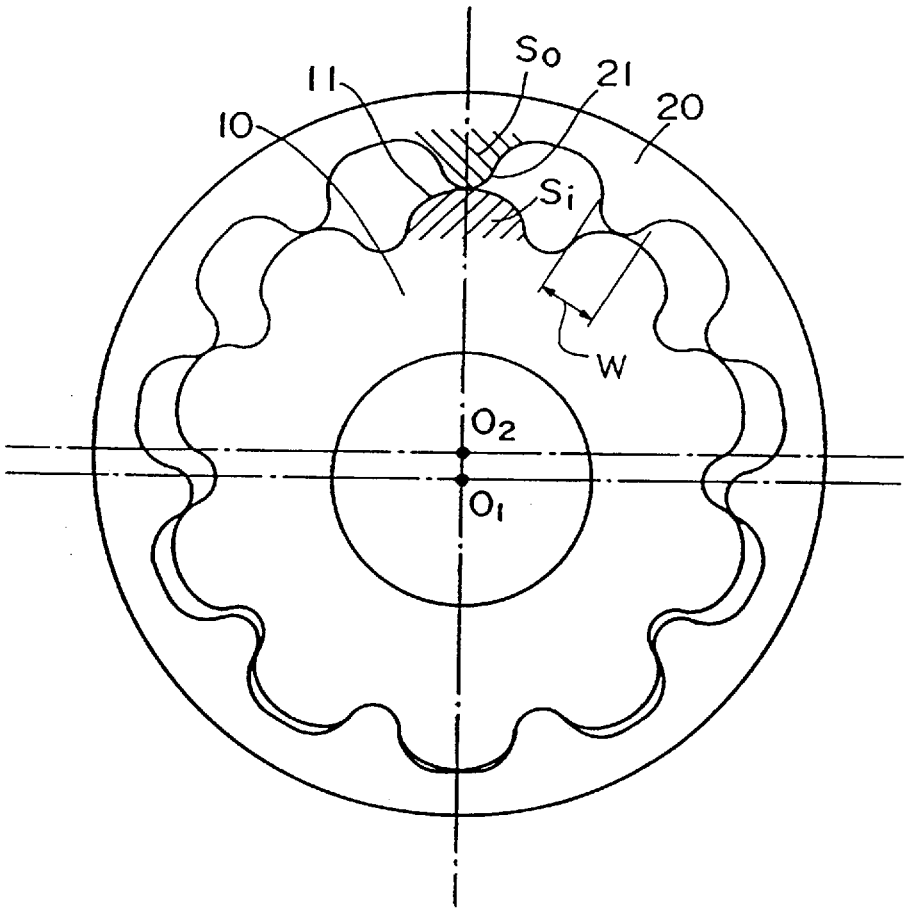

FIG. 4 is a planar view of an oil pump rotor offered as an example for comparison with the oil pump rotor shown in FIG. 1, wherein the outer teeth of the inner rotor are formed along an envelope described by a generated group of circles having centers positioned on a trochoid curve generated within the limits which satisfy the following expression:

$$n \cdot R/(p \cdot D) < 0.15$$

Figure 5:
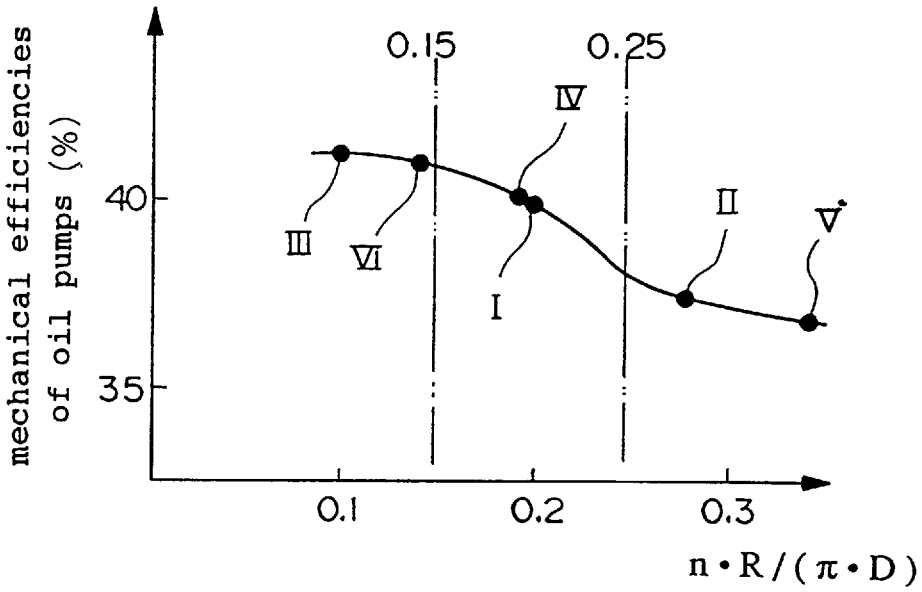

FIG. 5 is a graph showing the mechanical efficiencies of oil pumps having inner rotors with outer teeth formed using the value $n \cdot R/(p \cdot D)$, in cases wherein the value is arbitrarily chosen.

Figure 6A:
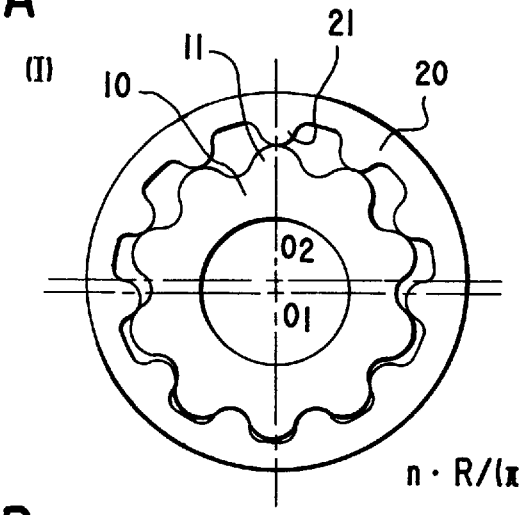
Figure 6B:
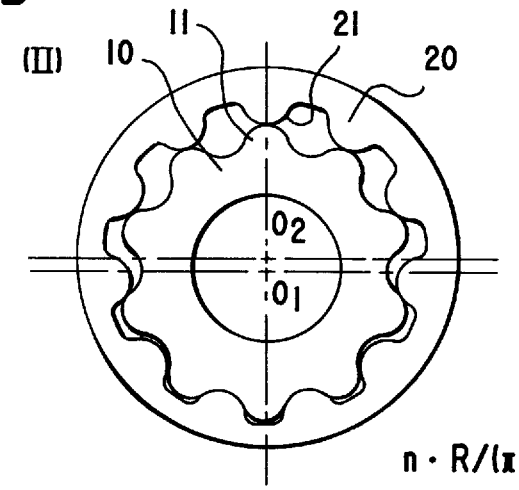
Figure 6C:
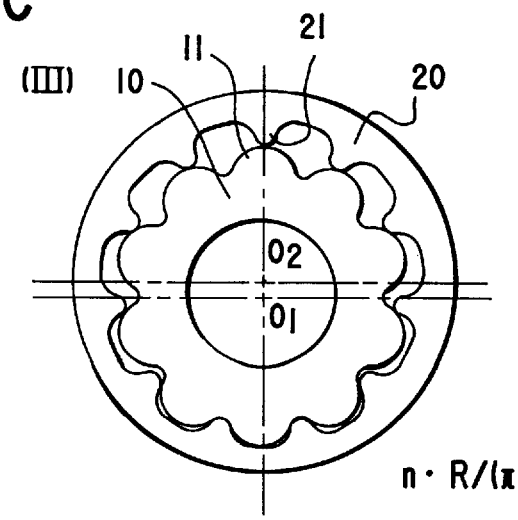

FIG. 6 shows planar views of oil pump rotors used in oil pumps corresponding to points indicated in FIG. 5.

Figure 7:
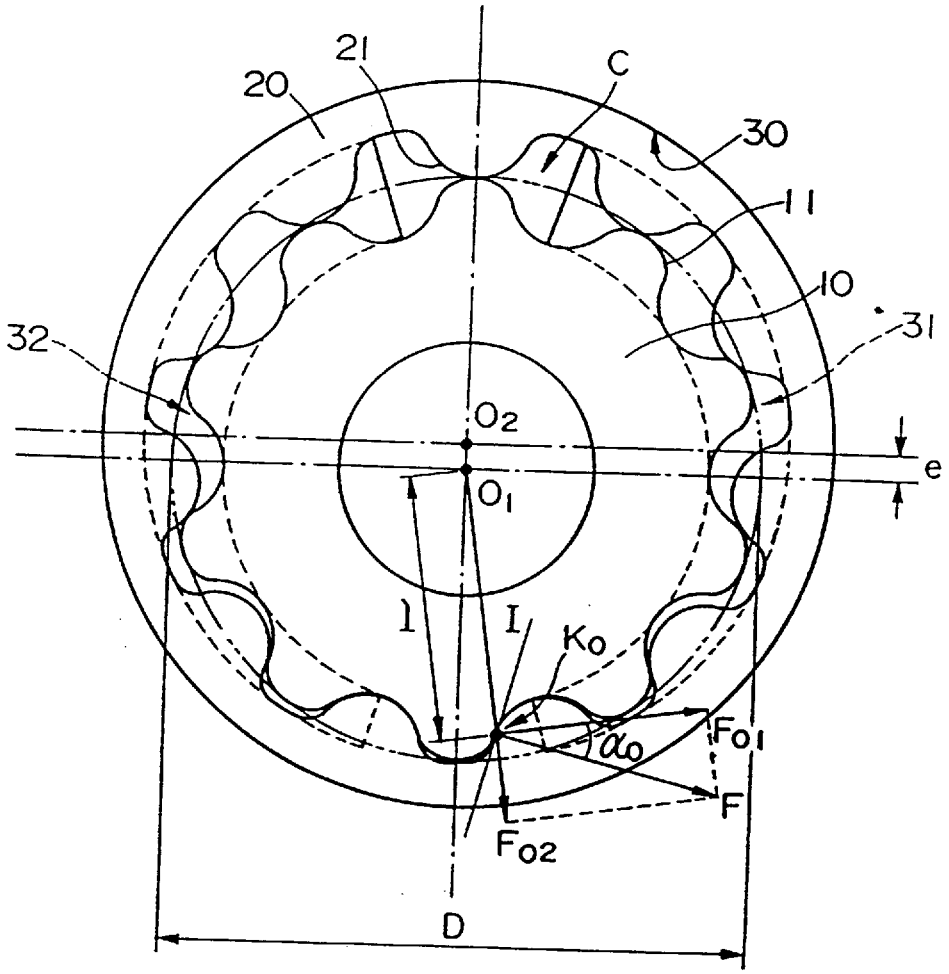

FIG. 7 is a planar view of a second embodiment of the oil pump rotor according to the present invention, wherein the outer teeth of the inner rotor are formed along an envelope described by a generated group of circles having centers positioned on a trochoid curve generated within the limits which satisfy the following expression:

$$0.135 \leqq e \cdot n/(p \cdot D) \leqq 0.145$$

Figure 8:
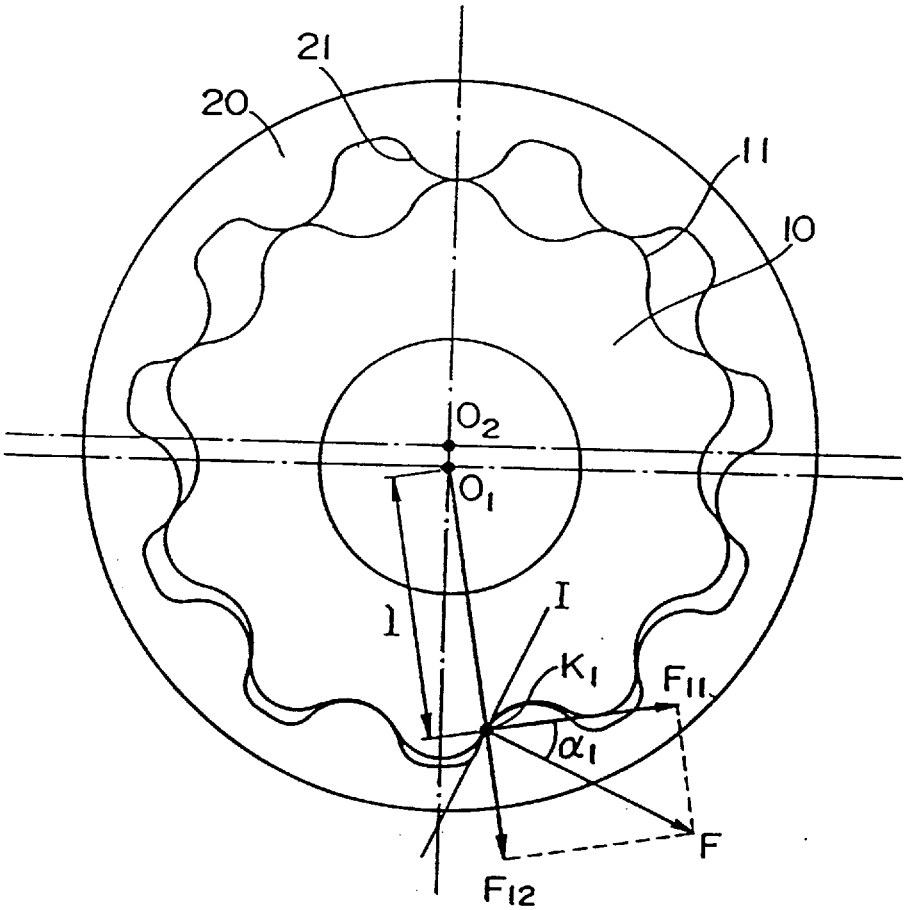

FIG. 8 is a planar view of an oil pump offered as an example for comparison with the oil pump rotor shown in FIG. 7, wherein the outer teeth of the inner rotor are formed along an envelope described by a generated group of circles having centers positioned on a trochoid curve generated within the limits which satisfy the following expression:

$$e \cdot n/(p \cdot D) < 0.135$$

Figure 9:
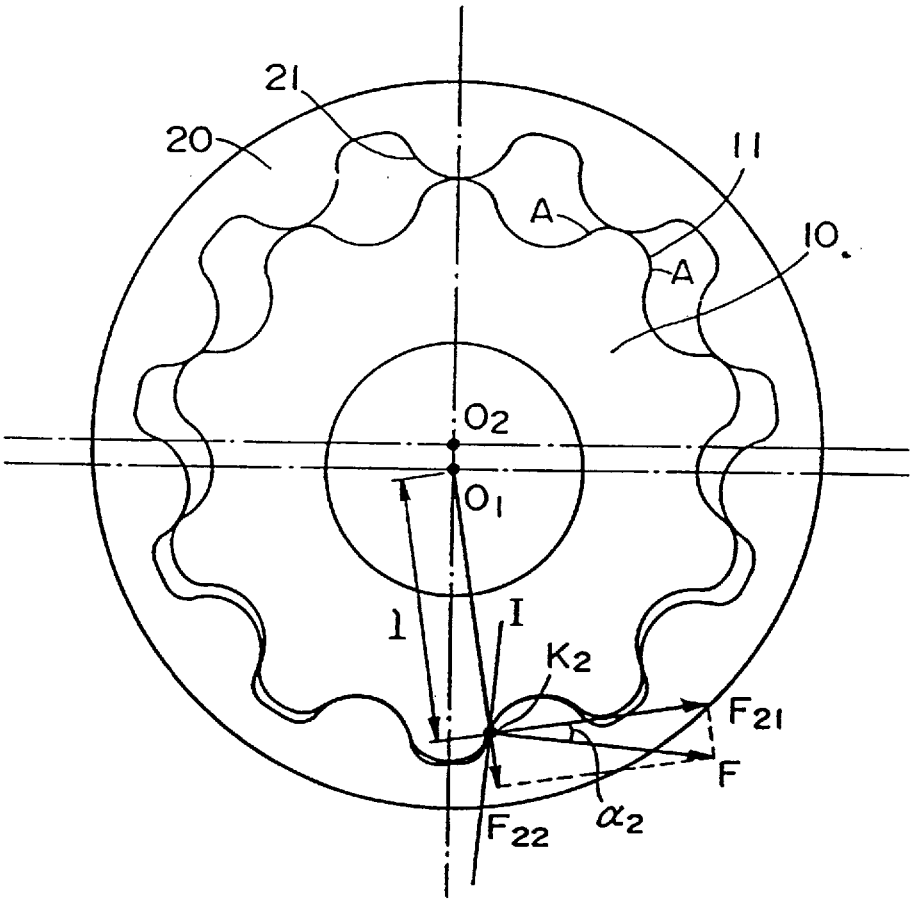

FIG. 9 is a planar view of an oil pump offered as an example for comparison with the oil pump rotor shown in FIG. 7, wherein the outer teeth of the inner rotor are formed along an envelope described by a generated group of circles having centers positioned on a trochoid curve generated within the limits which satisfy the following expression:

$$e \cdot n/(p \cdot D) > 0.145$$

Figure 10:
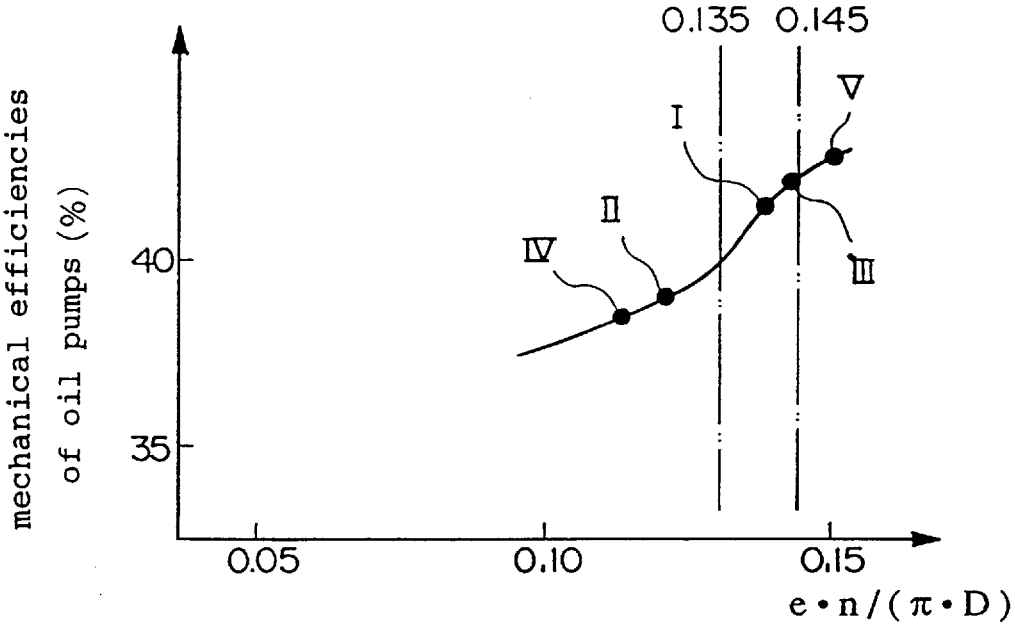

FIG. 10 is a graph showing the mechanical efficiencies of oil pumps having inner rotors with outer teeth formed using the value e·n/(p·D), in cases wherein the value is arbitrarily chosen.

Figure 11A:
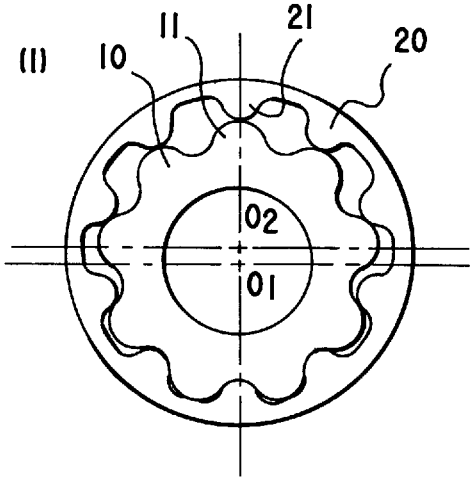
Figure 11B:
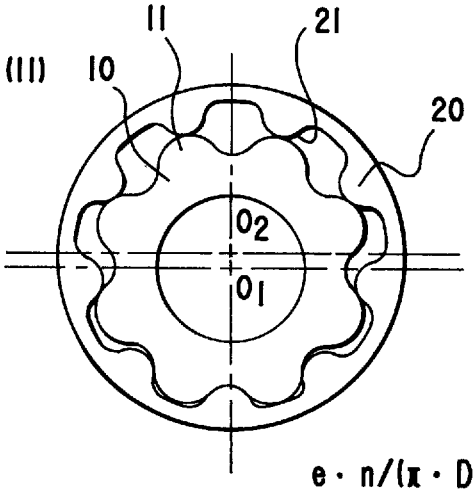

FIG. 11 shows planar views of oil pump rotors used in oil pumps corresponding to points indicated in FIG. 10.

Figure 12:
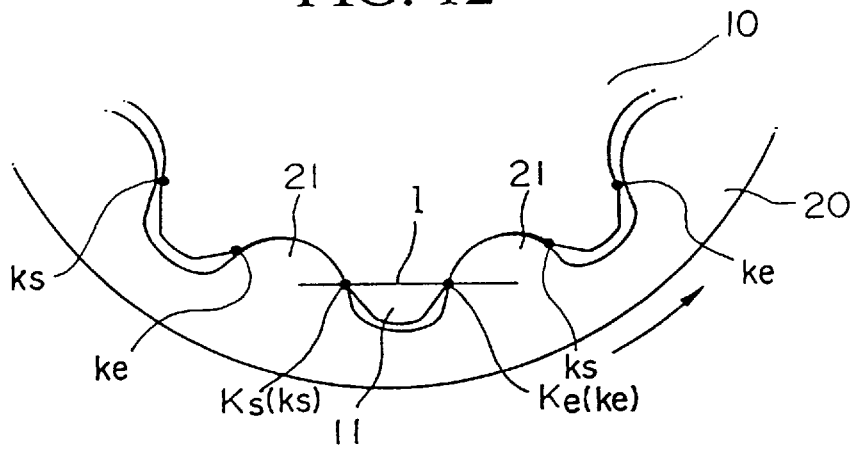

FIG. 12 is a planar view of a principal portion of a third embodiment of the oil pump rotor according to the present invention, showing the state of engagement between the outer teeth of the inner rotor and the inner teeth of the outer rotor.

Figure 13:
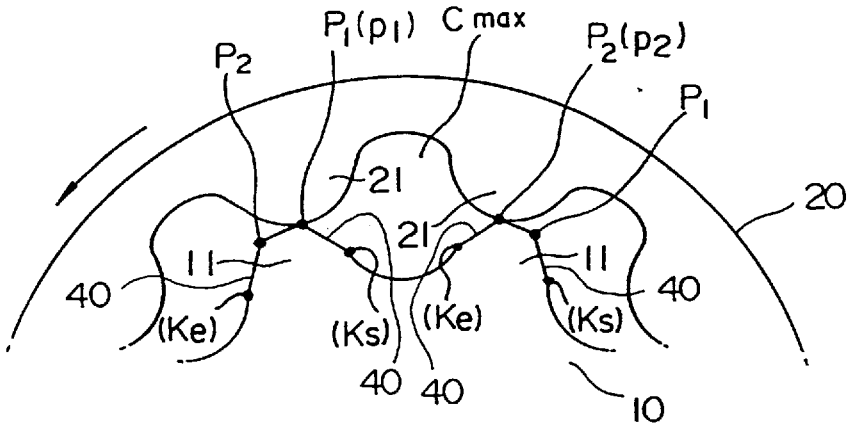

FIG. 13 is a planar view of a principal portion of a third embodiment of the oil pump rotor according to the present invention, showing the state of contact between the outer teeth of the inner rotor and the inner teeth of the outer rotor when the cell capacity is at a maximum.

Figure 14:
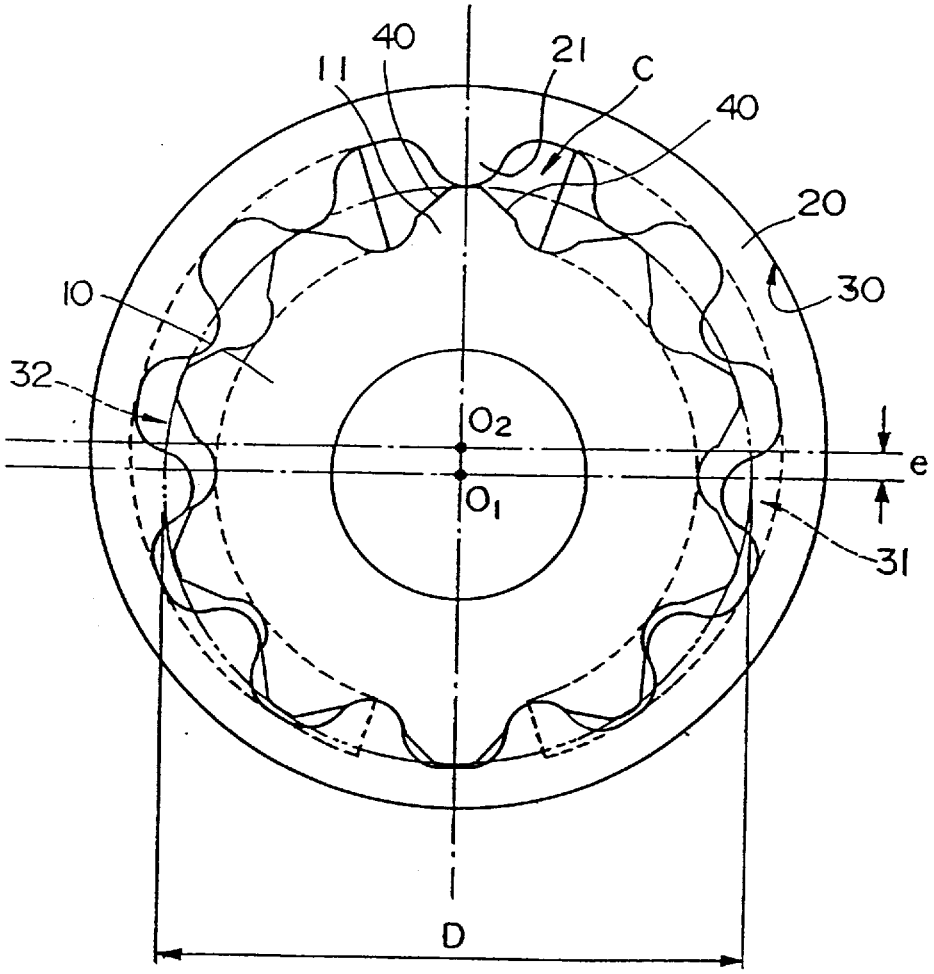

FIG. 14 is a planar view of a fourth embodiment of the oil pump rotor according to the present invention, wherein the outer teeth of the inner rotor are formed along an envelope described by a generated group of circles having centers positioned on a trochoid curve generated within the limits satisfying the following expression:

$$0.15 \leqq n \cdot R/(p \cdot D) \leqq 0.25$$

and $$0.135 \leqq e \cdot n/(p \cdot D) \leqq 0.145$$

and wherein run-offs are formed to each of the outer teeth at the front and rear of the direction of rotation.

DESCRIPTION OF THE PREFERRED EMBODIMENTS

A first embodiment of the oil pump rotor of the present invention will now be explained.

The oil pump rotor shown in FIG. 1 is provided with an inner rotor 10 to which n outer teeth are formed (wherein n is a natural number; n=10 in the present embodiment), an outer rotor 20 to which n+1 inner teeth are formed which engage with each of the outer teeth, and a casing 30 which houses inner rotor 10 and outer rotor 20 therein.

Inner rotor 10 is attached to a rotational axis, and is supported in a rotatable manner about axis center $O_1$. As shown in FIG. 2, outer teeth 11 of inner rotor 10 are formed along an envelope h described by a generated group of circles having centers positioned on a trochoid curve t generated within the limits satisfying the following expression:

$$0.15 \leqq n \cdot R/(p \cdot D) \leqq 0.25$$

where D is the diameter of the circle P which passes through each of the tips of outer teeth 11 and R is the radius of the generated circle Q measured in millimeters (FIG. 1 shows the case where n·R/(p·D)=0.2).

Outer rotor 20 is disposed such that its axial center $O_2$ is eccentric to the axial center $O_1$ of inner rotor 10, and is supported to enable rotation about this axis center $O_2$. Here, e indicates the amount of eccentricity. Inner teeth 21 of outer rotor 20 are formed along an envelope described by a generated group of circles having centers positioned on a trochoid curve generated within the same limits as indicated in the case of outer teeth 11 of inner rotor 10.

A plurality of cells C are formed in between the tooth surfaces of inner rotor 10 and outer rotor 20 along the direction of rotation of rotors 10,20. Each cell C is individually partitioned as a result of contact between respective outer teeth 11 of inner rotor 10 and inner teeth 21 of outer rotor 20 at the front and rear of the direction of rotation of the rotors 10,20, and by the presence of a casing 30 which exactly covers either side of the inner and outer rotors 10,20. As a result, independent fluid carrier chambers are formed. Cells C rotate and move in accordance with the rotation of rotors 10,20, with the capacity of each cell C reaching a maximum and falling to a minimum level during each rotation cycle as the rotors repeatedly rotate.

A circular intake port 31 is formed to casing 30 along the area in which the capacity of a given cell C formed between the tooth surfaces of rotors 10,20 is increasing. Similarly, a circular expulsion port 32 is formed along the area in which the capacity of a given cell C formed between the tooth surfaces of rotors 10,20 is decreasing.

The present invention is designed so that after the capacity of a given cell C has reached a minimum during the engagement between outer teeth 11 and inner teeth 12, fluid is taken into the cell as the cell's capacity expands as it moves along intake port 31. Similarly, after the capacity of a given cell C has reached a maximum during the engagement of outer teeth 11 and inner teeth 12, fluid is expelled from the cell as the cell's capacity decreases as it moves along expulsion port 32.

In an oil pump rotor of the above described design, a frictional torque T in opposition to the sliding resistance which is generated between the edge surfaces of rotors 10,20 and casing 30 when rotating rotors 10,20 may be calculated from the following equation:

$$T = M \cdot S \cdot l$$

where S is the sliding area with the edge surfaces of the rotors 10, 20, l is the distance from the center of rotation to the sliding part, and M is the frictional force per unit area operating between sides of the rotors 10,20 and the casing 30.

From this equation it may be understood that one means to reduce the frictional torque T is to place the sliding parts far from the rotational center, i.e., reduce the area of sliding between the edge surfaces of outer rotor 20 and casing 30.

This approach is taken into consideration in the oil pump rotor shown in FIG. 3, this oil pump being provided with an inner rotor 10 in which the outer teeth 11 thereof are formed along an envelope described by a generated group of circles having centers positioned on a trochoid curve generated within the following limits:

$$n \cdot R/(p \cdot D) > 0.25$$

In this oil pump rotor, the area of edge surface So of inner tooth 21 is large with respect to the area of edge surface Si of outer tooth 11. As a result, the sliding area of outer rotor 20 becomes large, causing the frictional torque T to increase as a result. (FIG. 3 shows the case where n·R/(p·D)=0.36).

FIG. 4 shows an oil pump rotor which is provided with an inner rotor 10 in which the outer teeth 11 thereof are formed along an envelope described by a generated group of circles having centers positioned on a trochoid curve generated within the following limits:

$$n \cdot R/(p \cdot D) < 0.15$$

In this oil pump rotor, the area of edge surface So of inner tooth 21 is small with respect to the area of edge surface Si of outer tooth 11. As a result, the sliding area of outer rotor 20 becomes small, causing the frictional torque T to decrease as a result. However, because the width W of inner teeth 21 along the direction of rotation of outer rotor 20 narrows, inner teeth 21 break easily during engagement with outer teeth 11. Accordingly, the durability of inner teeth 21 in the oil pump deteriorates. (FIG. 4 shows the case where n·R/(p·D)=0.145).

FIG. 5 shows the mechanical efficiencies of oil pumps having inner rotors 10 wherein the outer teeth 11 are formed by using arbitrarily chosen values for n·R/(p·D). First, it can be seen that the mechanical efficiency of the oil pump decreases as the value of n·R/(p·D) increases within the range n·R/(p·D)>0.25. Additionally, it can be seen that the mechanical efficiency of the oil pump increases as the value of n·R/(p·D) decreases within the range $0.15 \leqq n \cdot R/(p \cdot D) \leqq 0.25$. In the range of n·R/(p·D) <0.15, the mechanical efficiency of the oil pump does not largely increase, and as the value of n·R/(p·D) becomes smaller, the width W of the inner teeth 21 along the rotational direction of the outer rotor 20 becomes narrower as shown in FIG. 3, and the inner teeth become more likely to become worn.

FIG. 6 shows the oil pump rotors used in oil pumps corresponding to each point in the graph of FIG. 5. The oil pump rotors used in oil pumps corresponding to each of the points I, II and III on the graph are shown in FIG. 6(I), FIG. 6(II) and FIG. 6(III). The oil pump rotors used in the oil pumps corresponding to the points IV, V and VI on the graph are those shown in FIG. 1, FIG. 3 and FIG. 4 respectively.

Based on the above, then, an oil pump rotor as shown in FIG. 1 may be provided wherein the outer teeth 11 of inner rotor 10 are formed along an envelope described by a generated group of circles having centers positioned on a trochoid curve generated within the following limits:

$$0.15 \leqq n \cdot R/(p \cdot D) \leqq 0.25$$

The shape of outer rotor 20 in this oil pump is determined by the shape of inner rotor 10, with the area of edge surface $S_o$ of inner teeth 21 of the outer rotor 20 made small to an extent which does not give rise to ready breakage of the inner teeth. As a result, the entire sliding area of outer rotor 20 becomes smaller, reducing the drive torque T. Therefore, it becomes possible to reduce the mechanical loss caused by sliding resistance between outer rotor 20 and casing 30, while at the same time ensuring the durability of inner teeth 21. Accordingly, the durability and reliability of the oil pump is ensured, while the mechanical efficiency thereof can be improved.

A second embodiment of the oil pump rotor according to the present invention will now be explained. Structural components identical to those explained above will be assigned the same numeric symbol and an explanation thereof will be omitted.

In the oil pump rotor shown in FIG. 7, the outer teeth 11 of the inner rotor 10 are formed along an envelope described by a generated group of circles having centers positioned on a trochoid curve generated within the limits satisfying the following expressions below, the first of which was also indicated in case of the first embodiment above:

$$0.15 \leqq n \cdot R/(p \cdot D) \leqq 0.25$$

and $$0.135 \leqq e \cdot n/(p \cdot D) \leqq 0.145$$

Further, the shape of outer rotor 20 is determined by the shape of inner rotor 10 (FIG. 7 shows the case where e·n/(p·D)=0.143).

In an oil pump rotor having the structure as described above, inner rotor 10 is driven by means of the rotational axis to which it is affixed. Inner teeth 21 are pushed due to engagement with outer teeth 11, causing subordinate movement of outer rotor 20. When considering a point $K_0$ a distance 1 from axial center $O_1$ of inner rotor 10 at which engagement between inner teeth 21 and outer teeth 11 occurs (engagement angle:$\alpha_0$), the force F with which outer teeth 11 push inner teeth 21 is applied in a vertical direction on the engagement surface I.

This force F may be broken down into a rotational component $F_{01}$ which is applied along the tangential direction of inner rotor 10 for rotating outer rotor 20, and a slide component $F_{02}$ which is applied along the radial direction of inner rotor 10 for generating sliding between the teeth surfaces. These may be expressed as follows.

$$F01 = F \cdot \cos \alpha_0$$

$$F02 = F \cdot \sin \alpha_0$$

Based on the preceding, the oil pump rotor shown in FIG. 8 may be provided, wherein outer teeth 11 of inner rotor 10 are formed along an envelope described by a generated group of circles having centers positioned on a trochoid curve generated within the following limits:

$$0.15 \leqq n \cdot R/(p \cdot D) \leqq 0.25$$

and $$e \cdot n/(p \cdot D) < 0.135$$

In this oil pump rotor, the engagement angle $\alpha_1$ at engagement point $K_1$ between outer teeth 11 and inner teeth 21 which is positioned a distance 1 from center axis $O_1$ of inner rotor 10 is larger than engagement angle $\alpha_0$ at engagement point $K_0$. The force F with which outer teeth 11 press inner teeth 21 may be broken down into a rotational component $F_{11}$ for rotating outer rotor 20 and a slide component $F_{12}$ for generating sliding between the teeth surfaces. These components may be expressed as follows.

$$F_{11} = F \cdot \cos \alpha_1$$

$$F_{12} = F \cdot \sin \alpha_1$$

(FIG. 8 shows the case where e·n/(p·D)=0.1136).

Since $\alpha_1 > \alpha_0$ in this case, when the individual rotational components are compared, the following expression results:

$$F_{11} (= F \cdot \cos \alpha_1) < F_{01} (= F \cdot \cos \alpha_0)$$

Similarly, when the slide components are compared, the following expression is obtained:

$$F_{12}(=F\cdot\sin\alpha_1)>F_{02}(=F\cdot\sin\alpha_0)$$

As these equations show, the rotational component becomes smaller and the slide component becomes larger as the engagement angle increases. Accordingly, rotational component $F_{11}$ becomes smaller than rotational component $F_{01}$. In order to obtain a rotational component $F_{11}$ which is of an equivalent size as rotational component $F_{01}$, it is necessary that the force with which outer teeth 11 press against inner teeth 21 be large.

In the oil pump rotor shown in FIG. 9, the outer teeth 11 of the inner rotor 10 are formed along an envelope described by a generated group of circles having centers positioned on a trochoid curve generated within the limits satisfying the following expressions:

$$0.15\leqq n\cdot R/(p\cdot D)\leqq 0.25$$

and $$e\cdot n/(p\cdot D)>0.145$$

In this oil pump rotor, the engagement angle $\alpha_2$ at engagement point $K_2$ between inner teeth 21 and outer teeth 11 which is positioned a distance 1 from center axis $O_1$ of inner rotor 10 is smaller than engagement angle $\alpha_0$ at engagement point $K_0$. The force F with which outer teeth 11 press inner teeth 21 may be broken down into a rotational component $F_{21}$, for rotating outer rotor 20 and a slide component $F_{22}$ for generating sliding between the teeth surfaces. These components may be expressed as follows:

$$F_{21}=F\cdot\cos\alpha_2$$

$$F_{22}=F\cdot\sin\alpha_2$$

(FIG. 9 shows the case when e·n/(p·D)=0.15).

Since $\alpha_2<\alpha_0$ in this case, when the individual rotational components are compared, the following expression is obtained:

$$F_{21}(=F\cdot\cos\alpha_2)>F_{01}\ (=F\cdot\cos\alpha_0)$$

Similarly, when the slide components are compared, the following expression is obtained:

$$F_{22}(=F\cdot\sin\alpha_2)<F_{02}\ (=F\cdot\sin\alpha_0)$$

As these equations show, the rotational component becomes larger and the slide component becomes smaller as the engagement angle decreases. Accordingly, rotational component $F_{21}$ becomes larger than rotational component $F_{01}$, making it possible to rotate outer rotor 20 with a larger force. In other words, even if outer teeth 11 push inner teeth 21 with a small force, it is possible to obtain a rotational component $F_{21}$ which is of an equivalent size as rotational component $F_{01}$.

However, from the perspective of the shape of outer teeth 11 of inner rotor 10, although engagement angle $\alpha_2$ becomes small, edge portions which protrude outward in the rotational direction of the inner rotor 10 are formed at portions on both sides of the tips of the teeth on the outer teeth 11. When these edge portions rotate while the inner rotor 10 is combined with the outer rotor 20, the face pressure near the protruding edge portions increases, giving rise to severe abrasion of the edge portions and causing the durability of the outer teeth 11 to decrease.

FIG. 10 shows the mechanical efficiencies of oil pumps having inner rotors 10 wherein the outer teeth 11 are formed by using arbitrarily chosen values for e·n/(p·D). First, it can be seen that the mechanical efficiency of the oil pump decreases as the value of e·n/(p·D) decreases within the range e·n/(p·D)<0.135. Additionally, it can be seen that the mechanical efficiency of the oil pump increases as the value of e·n/(p·D) increases within the range $0.135\leqq e\cdot n/(p\cdot D)\leqq 0.145$. In the range of e·n/(p·D)>0.145, edge portions are formed on the portions on both sides of the tips of the outer teeth 11 shown in FIG. 8, giving rise to severe abrasion of the edge portions and causing the durability of the outer teeth 11 to decrease.

FIG. 11 shows the oil pump rotors used in oil pumps corresponding to each point in the graph of FIG. 10. The oil pump rotors used in oil pumps corresponding to each of the points I and II on the graph are shown in FIG. 11(I) and FIG. 11(II). The oil pump rotors used in the oil pumps corresponding to the points III, IV and V on the graph are those shown in FIG. 7, FIG. 8 and FIG. 9 respectively.

Thus, in the oil pump rotor shown in FIG. 7, the engagement angle between inner teeth 21 and outer teeth 11 is set to a suitable range by forming outer teeth 11 of inner rotor 10 along an envelope described by a generated group of circles having centers positioned on a trochoid curve generated within the limits which satisfy the following:

$$0.15\leqq n\cdot R/(p\cdot D)\leqq 0.25$$

and $$0.135\leqq e\cdot n/(p\cdot D)\leqq 0.145$$

Thus, in addition to the effects offered by the first embodiment, the formation of edge portions on either side of an outer tooth 11 in this oil pump is restrained, ensuring the durability of outer teeth 11. Further, it is possible to reduce the slide component which causes mechanical loss and ensure a sufficient rotational component, while effectively communicating the force F for rotating outer rotor 20 from outer teeth 11 to inner teeth 21.

A third embodiment of the oil pump rotor according to the present invention will now be explained. Structural components identical to those explained above will be assigned the same numeric symbol and an explanation thereof will be omitted.

In this oil pump rotor, the outer teeth 11 of the inner rotor 10 are formed along an envelope described by a generated group of circles having centers positioned on a trochoid curve generated within the limits satisfying the expression below, these limits also being indicated in case of the first embodiment above:

$$0.15\leqq n\cdot R/(p\cdot D)\leqq 0.25$$

Further, a run-off 40 is formed to each of the outer teeth 11 to the front and rear of the direction of rotation. Run-off 40 is not in contact with inner teeth 21 of outer rotor 20.

FIG. 12 shows the state of engagement between the outer teeth 11 of the inner rotor 10 and the inner teeth 21 of the outer rotor 20. When the tips of outer teeth 11 of inner rotor 10 engage in the tooth spaces of inner teeth 21 to rotate outer rotor 20, the line indicating the direction of the force with which outer teeth 11 push inner teeth 21 is referred to as the "line of action". In the figure, this line of action is indicated by the symbol 1. The engagement between outer teeth 11 and inner teeth 21 is carried out along this line of action 1. The points on the surface of outer teeth 11 which form the intersecting point $K_s$ at which engagement begins and the intersecting point $K_e$. at which engagement ends are ordinarily fixed, and may be designated as engagement start point $k_s$ and engagement end point $k_e$ of outer teeth 11. From the perspective of a single outer tooth, for example, engagement start point $k_s$ is formed to the rear of the direction of rotation, while engagement end point $k_e$ is formed to the front of the direction of rotation.

FIG. 13 shows the state of contact between outer teeth 11 of inner rotor 10 and inner teeth 21 of outer rotor 20 when the capacity of cell C reaches a maximum value. The capacity of cell C reaches a maximum value when the tooth spaces between outer teeth 11 and the tooth spaces between inner teeth 21 are exactly opposite one another. In this case, the tip of inner tooth 21 and the tip of outer tooth 11 which are positioned at the front of cell $C_{max}$ come in contact at contact point $P_1$, while the tip of outer tooth 11 which is positioned to the rear of cell $C_{max}$ comes in contact with contact point $P_2$. The points on outer tooth 11 which form contact points $P_1$, $P_2$ where the cell capacity becomes maximum are ordinarily fixed, and may be designated as front contact point $P_1$ and rear contact point $P_2$ of outer tooth 11. From the perspective of a single outer tooth 11, for example, front contact point $P_1$ is formed to the rear of the direction of rotation, while rear contact point $P_2$ is formed to the front of the direction of rotation.

Run-off 40 is formed such that it cuts off the tooth surface between the engagement end point $k_e$ and the rear contact point $P_2$ which are positioned to the front of the direction of rotation, and the tooth surface between engagement start point $k_s$ and front contact point $P_1$ which are positioned to the rear of the direction of rotation. As a result, there is no contact between the surface of outer tooth 11 and inner tooth 21.

In an oil pump rotor of the above described design, the increase and decrease in the capacity of a cell C and the contact between outer teeth 11 of inner rotor 10 and inner teeth 12 of outer rotor 20 throughout one cycle takes place as described below.

During the engagement of outer tooth 11 and inner tooth 21, the tip of outer tooth 11 engages with the tooth space of inner tooth 21 to rotate outer rotor 20 in the same way as in a conventional oil pump.

Once the engagement between outer tooth 11 and inner tooth 21 ends, the capacity of cell C begins to increase as it moves along intake port 31. Due to the provision of run-off 40 at the front of the direction of rotation in outer tooth 11 of inner rotor 10 (which was in contact with the inner tooth of the outer rotor in the conventional oil pump), the contact between outer tooth 11 and inner tooth 21 at the front and rear of cell C does not occur.

When the forward portion of cell C comes into communication with intake port 31, the tip of the outer tooth 11 and the tip of the inner tooth 21 which are positioned at the front of cell C come into contact. When the rear portion of cell C comes into communication with intake port 31, the tip of the inner tooth 21 and the tip of the outer tooth 11 which are positioned to the rear of cell C come in contact. In this way, a cell $C_{max}$ having a maximum capacity is formed between intake port 31 and expulsion port 32. The contact between the tip of the outer tooth 11 and the tip of the inner tooth 21 which are positioned to the rear of cell C are maintained in this configuration until this contact point reaches expulsion port 31.

Next, the capacity of cell C begins to decrease as the cell moves along expulsion port 31. Due to the provision of run-off 40 to the rear of the direction of rotation of outer tooth 11 of inner rotor 10 (which was in contact with the inner tooth of the outer rotor in conventional oil pump), contact between outer tooth 11 and inner tooth 21 does not occur.

In the process during which the capacity of cell C increases as it moves along intake port 31 and the process during which the capacity of cell C decreases as it moves along expulsion port 32, adjacent cells C enter a state of communication with one another due to the provision of run-offs 40. However, in both these processes, each of the cells are in a state of communication due to positioning along intake port 31 or expulsion port 32. Thus, a decrease in the carrier efficiency of the oil pump is not caused by adjacent cells C entering a state of communication with one another as described above.

As a result, outer teeth 11 and inner teeth 21 come in contact only during the engagement process therebetween, and during the process in which the capacity of a cell C reaches a maximum and then moves from intake port 31 to expulsion port 32. Outer teeth 11 and inner teeth 21 do not come in contact during the process in which the capacity of a cell C increases as the cell moves along intake port 31 and the process in which the capacity of cell C decreases as the cell moves along expulsion port 32. Thus, the number of sites where sliding contact occurs between inner rotor 10 and outer rotor 20 is decreased so that the sliding resistance generated between the teeth surfaces is small.

Taking into consideration the preceding, an oil pump rotor may be proposed in which the outer teeth 11 of inner rotor 10 are formed along an envelope described by a generated group of circles having centers positioned on a trochoid curve generated within the limits satisfying the following expression:

$$0.15 \leqq n \cdot R/(p \cdot D) \leqq 0.25$$

Run-offs 40 which are not in contact with the inner teeth 21 of outer rotor 20 are provided to each outer tooth 11 at the front and rear of the direction of rotation. In this oil pump, engagement occurs between outer teeth 11 and inner teeth 21 only during the engagement process therebetween, and during the process in which the capacity of cell C reaches a maximum and then moves from intake port 31 to expulsion port 32. Outer teeth 11 and inner teeth 21 do not come in contact during the process in which the capacity of cell C increases as the cell moves along intake port 31 and the process in which the capacity of cell C decreases as the cell moves along expulsion port 32, thus reducing the number of sites of sliding contact between inner rotor 10 and outer rotor 20. Accordingly, in addition to the effects provided by the oil pump of the first embodiment as described above, it is also possible to reduce the amount of drive torque needed to drive the oil pump, thereby improving its mechanical efficiency. Furthermore, mechanical loss is reduced by preventing interference between the outer teeth 11 of the inner rotor 10 and the inner teeth 21 of the outer rotor 20 which occurs due to vibrations of the oil pump during actual use of the oil pump, by means of providing the run-off 40 to the rear of the direction of rotation of the outer teeth 11.

While the inner rotor 10 is constructed by providing run-offs 40 to the front and rear sides respectively of the direction of rotation of the outer teeth 11 in the present embodiment, a run-off 40 may be provided on only the front of the rotational direction of the outer teeth 11.

A fourth embodiment of the oil pump rotor according to the present invention is shown in FIG. 14. Structural components identical to those explained above will be assigned the same numeric symbol and an explanation thereof will be omitted.

In the oil pump rotor shown in FIG. 14, the outer teeth 11 of the inner rotor 10 are formed along an envelope described by a generated group of circles having centers positioned on a trochoid curve generated within the limits satisfying the following expressions below, these expressions also being indicated in the case of the preceding second embodiment:

$$0.15 \leqq n \cdot R/(p \cdot D) \leqq 0.25$$

and $$e \cdot n/(p \cdot D) < 0.135$$

Additionally, in this embodiment, a run-off 40 is formed to the front and the rear of the direction of rotation of each of the outer teeth 11.

In addition to all the various characteristics attributed to the oil pump rotors according to each of the preceding first through third embodiments, the oil pump rotor according to this fourth embodiment also provides the following effects.

1. Mechanical loss due to sliding resistance occurring between casing 30 and the edge surfaces of outer rotor 20 is decreased, while ensuring the durability of the inner teeth 21 of the outer rotor 20.
2. Mechanical loss in the form of the slide component is reduced while maintaining a sufficient rotational component and ensuring the durability of the outer teeth 11 of inner rotor 10.
3. Mechanical loss due to sliding resistance occurring between the surfaces of inner teeth 21 of outer rotor 20 and outer teeth 11 of inner rotor 10 is reduced.

While the invention has been particularly shown and described in reference to preferred embodiments thereof, it will be understood by those skilled in the art that changes in form and details may be made therein without departing from the spirit and scope of the invention.

What is claimed:

1. An oil pump rotor for an oil pump provided with an inner rotor to which n (n is a natural number) outer teeth are formed, an outer rotor to which n+1 inner teeth are formed which engage with each of the outer teeth, and a casing in which an intake port for taking up fluid and an expulsion port for expelling fluid are formed, fluid being taken up and expelled in this oil pump by means of changes in the capacity of a plurality of cells which are formed between the teeth surfaces of each rotor during the engagement and rotation of the rotors, wherein:

the outer teeth of the inner rotor are formed along an envelope described by a generated group of circles having centers positioned on a trochoid curve generated within the limits satisfying the following expression:

$$0.15 \leqq n \cdot R/(p \cdot D) \leqq 0.25$$

where D is the diameter of the circle which passes through each of the tips of the outer teeth and R is the radius of the generated circle measured in millimeters, while p is $\pi$.

2. An oil pump rotor according to claim 1, wherein the outer teeth of the inner rotor are formed along an envelope described by a generated group of circles having centers positioned on a trochoid curve generated within the limits satisfying the following expression:

$$0.135 \leqq e \cdot n/(p \cdot D) \leqq 0.145$$

where e is the eccentricity between the inner and outer rotors.

3. An oil pump rotor according to claim 1, wherein a run-off is formed to each of the outer teeth of the inner rotor at the front of the direction of rotation, the run-off not having contact with the inner teeth of the outer rotor.

4. An oil pump rotor according to claim 3, wherein the run-off is formed between the engagement point when an outer tooth of the inner rotor engages with an inner tooth of the outer rotor, and the contact point between an outer tooth of the inner rotor and an inner tooth of the outer rotor when the cell capacity is at a maximum.

5. An oil pump rotor according to claim 3, wherein the run-off is formed to a portion of the area between the engagement point when an outer tooth of the inner rotor engages with an inner tooth of the outer rotor, and the contact point between an outer tooth of the inner rotor and an inner tooth of the outer rotor when the cell capacity is at a maximum.

6. An oil pump rotor according to claim 3, wherein a run-off is formed to each of the outer teeth of the inner rotor at the rear of the direction of rotation.

7. An oil pump rotor according to claim 6, wherein the run-off is formed between the engagement point when an outer tooth of the inner rotor engages with an inner tooth of the outer rotor, and the contact point between an outer tooth of the inner rotor and an inner tooth of the outer rotor when the cell capacity is at a maximum.

8. An oil pump rotor according to claim 6, wherein the run-off is formed to a portion of the area between the engagement point when an outer tooth of the inner rotor engages with an inner tooth of the outer rotor, and the contact point between an outer tooth of the inner rotor and an inner tooth of the outer rotor when the cell capacity is at a maximum.

9. An oil pump rotor according to claim 2, wherein a run-off is formed to each of the outer teeth of the inner rotor at the front of the direction of rotation, the run-off not having contact with the inner teeth of the outer rotor.

10. An oil pump rotor according to claim 9, wherein the run-off is formed between the engagement point when an outer tooth of the inner rotor engages with an inner tooth of the outer rotor, and the contact point between an outer tooth of the inner rotor and an inner tooth of the outer rotor when the cell capacity is at a maximum.

11. An oil pump rotor according to claim 9, wherein the run-off is formed to a portion of the area between the engagement point when an outer tooth of the inner rotor engages with an inner tooth of the outer rotor, and the contact point between an outer tooth of the inner rotor and an inner tooth of the outer rotor when the cell capacity is at a maximum.

12. An oil pump rotor according to claim 9, wherein a run-off is formed to each of the outer teeth of the inner rotor at the rear of the direction of rotation.

13. An oil pump rotor according to claim 12, wherein the run-off is formed between the engagement point when an outer tooth of the inner rotor engages with an inner tooth of the outer rotor, and the contact point between an outer tooth of the inner rotor and an inner tooth of the outer rotor when the cell capacity is at a maximum.

14. An oil pump rotor according to claim 12, wherein the run-off is formed to a portion of the area between the engagement point when an outer tooth of the inner rotor engages with an inner tooth of the outer rotor, and the contact point between an outer tooth of the inner rotor and an inner tooth of the outer rotor when the cell capacity is at a maximum.

* * * * *